United States Patent [19]

Bottelsen

[11] 4,230,322

[45] Oct. 28, 1980

[54] NO BOUNCE DART

[76] Inventor: Walter E. Bottelsen, 7259 Del Norte, Goleta, Calif. 93017

[21] Appl. No.: 5,142

[22] Filed: Jan. 22, 1979

[51] Int. Cl.[3] ..... A63B 65/02

[52] U.S. Cl. ..... 273/420

[58] Field of Search ..... 273/106.5 R, 106.5 A, 273/106.5 B, 106 E, 419, 420, 416; 403/329, 372, 326

[56] References Cited

U.S. PATENT DOCUMENTS

| | | | |
|---|---|---|---|
| 367,578 | 8/1887 | Babb | 403/329 X |
| 434,295 | 8/1890 | Richardi | 403/329 X |
| 1,893,787 | 1/1933 | Schroeder . | |
| 2,119,524 | 6/1938 | Char | 273/106.5 A |
| 2,684,851 | 7/1954 | Stokes | 273/106 E |
| 2,890,072 | 6/1959 | Kaman et al. | 403/372 X |
| 4,101,126 | 7/1978 | Kurtz et al. | 273/106.5 B X |

FOREIGN PATENT DOCUMENTS

| | | | |
|---|---|---|---|
| 2642962 | 11/1977 | Fed. Rep. of Germany | 273/106.5 B |

*Primary Examiner*—Paul E. Shapiro

*Attorney, Agent, or Firm*—Harris, Kern, Wallen & Tinsley

[57] ABSTRACT

A dart having an elongate body with a point sliding in one end of the body and a tail carried at the other end of the body. The point is normally in an extended position. On impact with a target, or an obstruction adjacent a target, the momentum of the body causes the point to slide in the body to a position where the body impacts the head of the point and hammers the point into the target, past an obstruction, thereby reducing the likelihood of bounce of the dart.

6 Claims, 11 Drawing Figures

NO BOUNCE DART

BACKGROUND OF THE INVENTION

This invention relates to darts and in particular to a new and improved dart which substantially reduces the likelihood of bouncing of the dart on impact with a target or an obstruction.

In a dart game, the dart is shot or thrown to a target marked on a dart board. Typically the scoring areas are outlined by a wire grid on the face of the target. When a dart point strikes a wire, the dart is deflected and often does not stick in the target, that is, the dart bounces back and lands on the floor. When this occurs, the dart player scores no points and the darts often are damaged or the point is dulled by hitting the floor.

Accordingly, it is an object of the present invention to provide a new and improved dart which substantially solves the bounce problem. In particular, it is an object of the invention to provide a dart wherein the point moves with respect to the body, with the body providing a hammering action on the point when the point impacts the target or an obstruction, so as to drive the dart point forward into the target. It is a further object of the invention to provide such a dart wherein the interengagement between the point and body is uniform and symmetrical and provides for movement of the point head from a first extended position to a second hammering position without affecting the balance or accuracy of the dart. An additional object is to provide such a dart construction which is rugged and durable and have a life corresponding to that of the ordinary dart.

SUMMARY OF THE INVENTION

The dart includes an elongate body having an interior cavity and axial passage at one end and a tail at the other end. A point has a head positioned in the cavity and a shaft which slides in the passage for moving the head between a first position remote from the bottom of the cavity and a second position engaging the cavity bottom. A resilient member or members are carried on the body and/or the head for retaining the head in the first position and permitting movement of the head to the second position on target impact. The resilient member or members are disposed about the periphery of the cavity and the head for uniform engagement and operation.

DESCRIPTION OF THE PREFERRED EMBODIMENTS

Figure 1:
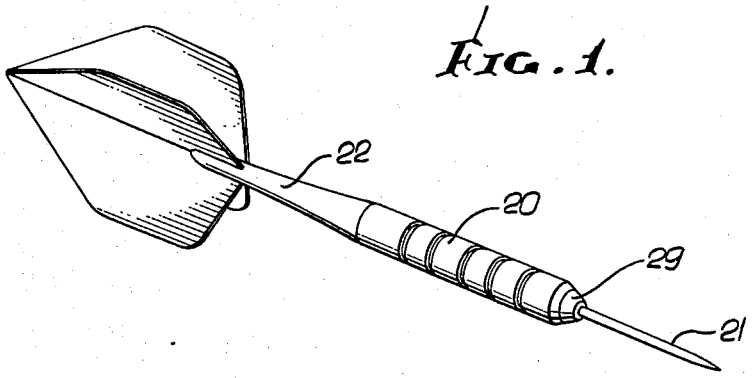
FIG. 1 is a perspective view of a dart incorporating the presently preferred embodiment of the invention.

The dart shown in FIGS. 1–5 includes a body 20, a point 21, and a tail assembly 22. Typically, the body 20 is a metal cylinder with a threaded opening 24 at one end for receiving a threaded boss 25 of the tail assembly 22.

A cavity 28 is provided at the other end of the body 20 and is closed by an insert 29 having a passage 30 therethrough for sliding of the shaft 31 of the point 21. The insert 29 may be a press fit into the body 20 or may be secured by cementing or otherwise as desired.

The insert 29 has four resilient fingers 33 which project into the cavity 28, with the tips of the fingers turned inwardly. An enlarged head 34 of the point 21 is normally positioned within the fingers 33, as shown in FIG. 2.

Figure 2:
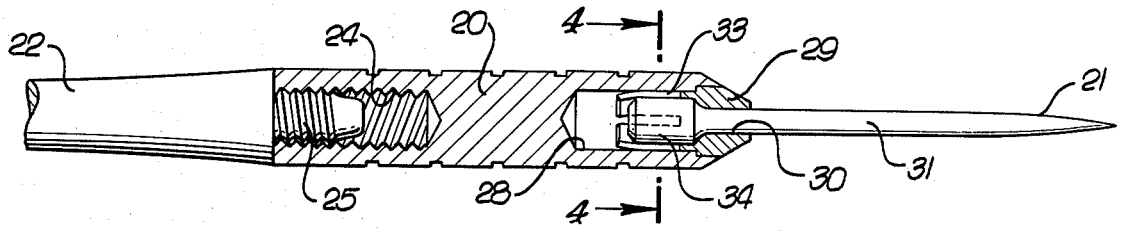
FIG. 2 is an enlarged partial sectional view of the dart of FIG. 1.
Figure 3:
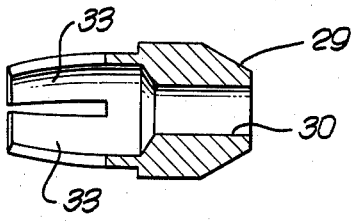
FIG. 3 is an enlarged sectional view of the insert of FIG. 2.
Figure 4:
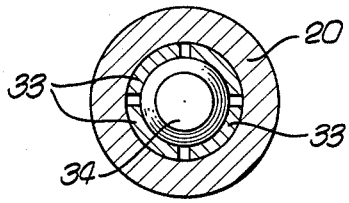
FIG. 4 is an enlarged sectional view taken along the line 4—4 of FIG. 2.
Figure 5:
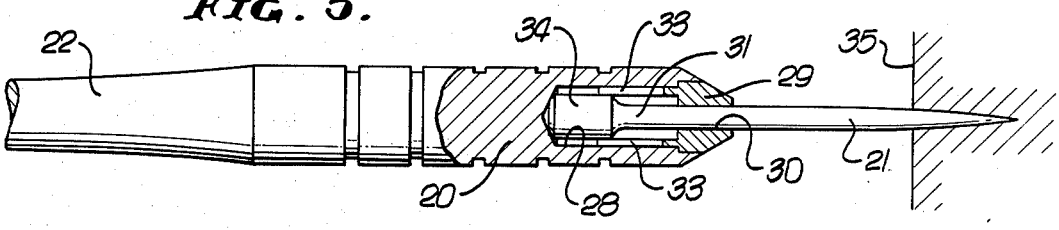
FIG. 5 is a view similar to that of FIG. 2 showing impact of the dart with a target.

The dart with the point in the extended position as shown in FIG. 2 is ready for use. When the thrown dart strikes a target 35 or an obstruction, the momentum of the body 20 causes the body to move forward relative to the point, causing the head 34 to expand the fingers 33 and move from the throwing position of FIG. 2 to the impact position of FIG. 5, with the body 20 impacting the head 34 and driving the point 21 forward. This hammering action obtained when the head moves through the insert and engages the body functions to fix the dart in the target and prevent bouncing. Preferably, the head 34 is tapered for ease of movement past the fingers 33. The fingers surround the head in the throwing position and engage the head on all sides at impact.

Figure 6:
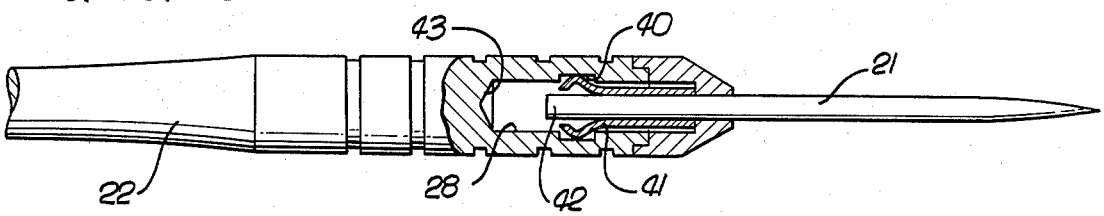
FIGS. 6, 7 and 8 are views similar to that of FIG. 2 showing alternative embodiments.

An alternative construction is shown in FIG. 6, where components corresponding to those of FIGS. 1–5 are identified by the same reference numerals. A groove 40 is provided in the inner wall of the cavity 28 of the body 20. A plurality of resilient fingers 41 are carried on the inner end of the point 21, with the fingers projecting outwardly into the groove 40. The dart is shown in the throwing position in FIG. 6. On engagement with a target, the body 20 moves to the right, moving the fingers 41 inwardly out of the groove, 40, with the head 42 of the point impacting the bottom 43 of the cavity to provide the hammering action.

Figure 7:
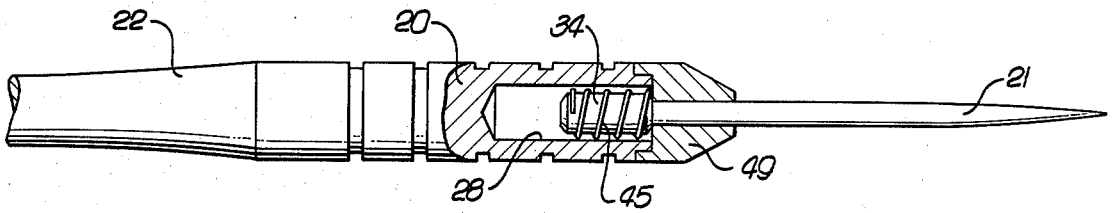

In the embodiment of FIG. 7, a coil spring 45 is carried on the head 34 of the point 21, typically by having the ends of the spring bent at right angles and inserted in openings in the head. The spring is designed so that it will be slightly compressed when inserted in the cavity 28 of the body 20, providing a resilient frictional engagement between the spring and the body. In use, the pin is pulled out to the throwing position of FIG. 7. When impacting a target, the body 20 moves forward and impacts the head, driving the point into the target.

Figure 8:
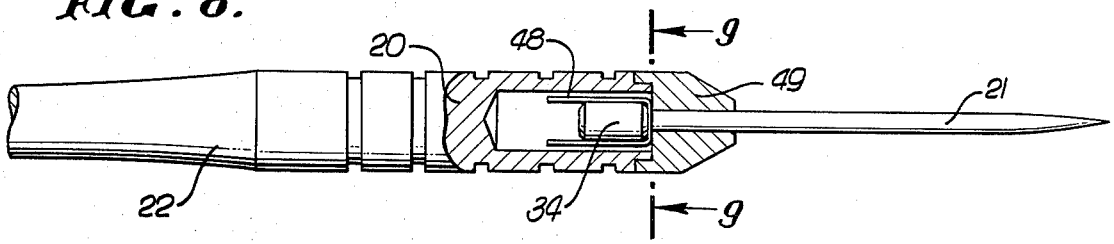
Figure 9:
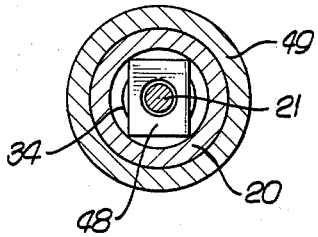
FIG. 9 is an enlarged sectional view taken along the line 9—9 of FIG. 8.

In the embodiment of FIG. 8, a U-shaped spring clip 48 is carried on the insert 49, engaging, the head 34 and providing sliding friction as the head moves in the clip, (normally retaining the point head in the throwing position). The dart operates in the same manner as previously described.

Figure 10:
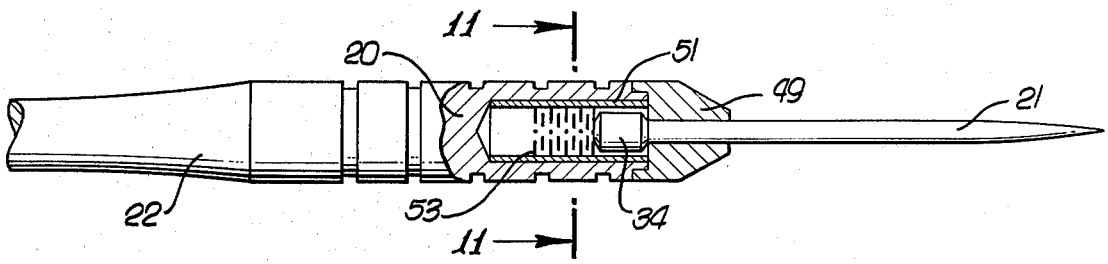
FIG. 10 is a view similar to that of FIG. 2 showing another alternative embodiment.
Figure 11:
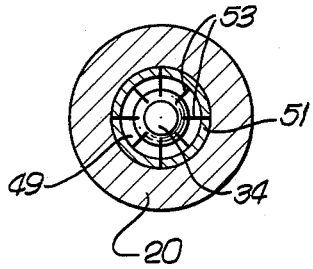
FIG. 11 is an enlarged sectional view taken along the line 11—11 of FIG. 10.

In the embodiment of FIGS. 10 and 11, a sleeve 51 is mounted in the cavity of the body 20, with the point 21 sliding in the insert 49 and with the head 34 positioned within the sleeve. A plurality of resilient spines 53 are carried within the sleeve 51, projecting inwardly, as shown in FIG. 11. The spines preferably are positioned in the central zone of the sleeve 51, leaving an open area at the right and at the left. In the throwing position as shown in FIG. 10, the head 34 is positioned at the right end of the sleeve. On impact, the head is forced past the spines 51 to the left end of the sleeve engaging the body. The spines may be of metal wire or plastic rod and may be mounted directly in the body if desired. However it is preferable to mount them in a sleeve which is then inserted into the body.

I claim:

1. In a dart, the combination of:

an elongate body having at one end, means defining an interior cavity of larger cross-section area and an axial passage of smaller cross-section area, and at the other end, means for mounting a tail;

a point with a head positioned in said cavity and a shaft slidable in said passage for reciprocating movement of said head between a first position with said head remote from the bottom of said cavity and a second position with said head engaging said cavity bottom;

said point and body including interengaging means disposed about substantially the entire periphery of said head and cavity resisting movement of said head from said first to said second position and maintaining engagement between said head and the wall of said cavity as said head moves from said first to said second position.

2. A dart as defined in claim 1 wherein said body cavity is closed by an insert having said axial passage therein, with said insert carrying a plurality of resilient fingers having inwardly directed portions tending to maintain said head in said first position, with said head movable past said fingers to engage said cavity bottom when said point impacts a target.

3. A dart as defined in claim 1 wherein said cavity includes a peripheral groove, and said head carries a plurality of resilient fingers having outwardly directed portions for engaging said groove and tending to maintain said head in said first position, with said head movable past said groove to engage said cavity when said point impacts a target.

4. A dart as defined in claim 1 wherein said interengaging means comprises a coil spring carried on said head and compressed within said cavity to engage the wall of said cavity.

5. A dart as defined in claim 1 wherein said interengaging means comprises a plurality of resilient spines carried in said body projecting into said cavity for engagement with said head.

6. A dart as defined in claim 1 wherein said interengaging means includes a resilient member disposed about and engaging said head as said head moves in said cavity.

* * * * *